United States Patent [19]

Hosoya

[11] Patent Number: 4,517,952

[45] Date of Patent: May 21, 1985

[54] TWIN IGNITION PLUG CONTROL SYSTEM FOR AN INTERNAL COMBUSTION ENGINE

[75] Inventor: Katsumi Hosoya, Yokohama, Japan

[73] Assignee: Nissan Motor Company, Limited, Yokohama, Japan

[21] Appl. No.: 440,533

[22] Filed: Nov. 10, 1982

[30] Foreign Application Priority Data

Jan. 13, 1982 [JP] Japan ..... 57-2123[U]

[51] Int. Cl.[3] ..... F02P 15/08

[52] U.S. Cl. ..... 123/638; 123/179 BG; 123/475; 123/480; 123/625

[58] Field of Search ..... 123/638, 625, 478, 480, 123/179 BG, 475, 640

[56] References Cited

U.S. PATENT DOCUMENTS 4,243,005 1/1981 Hisatomi ..... 123/638

*Primary Examiner*—Andrew M. Dolinar

*Attorney, Agent, or Firm*—Schwartz, Jeffery, Schwaab, Mack, Blumenthal & Koch

[57] ABSTRACT

A twin ignition plug control system for an internal combustion engine by which two point ignition is switched to one-point ignition only when engine load is heavy and the engine is not being warmed-up. Since the control system according to the present invention is so configured that many elements or sections can be used in common with a convention fuel injection valve control system, without providing various sensors or detectors such as a vacuum sensor disposed with an intake manifold for detecting engine load, a clutch switch or a neutral switch for detecting engine idling, etc., it is possible to simplify the twin ignition plug control system and thus reduce the manufacturing cost. When a microcomputer is incorporated within the fuel injection valve control system, in particular, the present invention is advantageous.

13 Claims, 4 Drawing Figures

TWIN IGNITION PLUG CONTROL SYSTEM FOR AN INTERNAL COMBUSTION ENGINE

BACKGROUND OF THE INVENTION

1. Field of the Invention

The present invention relates generally to a twin ignition plug control system for an internal combustion engine and more specifically to an ignition control system which can switch two-point ignition to one-point ignition or vice versa according to engine load in a fuel-injection type internal combustion engine having two ignition plugs for each engine cylinder.

2. Description of the Prior Art

As is well known, there exists some twin ignition plug control system for a fuel-injection type internal combustion engine which can switch from two-point ignition to one-point ignition or vice versa for each engine cylinder according to the magnitude of engine load.

An exhaust gas recirculation system is often adopted for an internal combustion engine, in order to reduce NOx exhausted from the engine, by recirculating part of exhaust gas from the intake port to the exhaust port and thus lowering the combustion temperature. This recirculation system, however, is usually disabled when the engine is running at a low speed or when engine coolant temperature is low, that is, when the engine is running under relatively heavy load or is being idled, in order to obtain a reliable and stable engine operation.

In order to obtain more reliable ignition performance even when exhaust gas is being recirculated, two-point ignition method is adopted in which an ignition plug is disposed on the intake port side and on the exhaust port side, respectively, for each engine cylinder for increasing the combustion speed in the mixture including the recirculated exhaust gas.

In the two-point ignition systems, a relatively-intense combustion noise is produced when the two plugs are ignited simultaneously while the engine is running under heavy load. Therefore, when the engine load exceeds a predetermined level, the two-point ignition is switched to a one-point ignition to reduce combustion speed and thus reduce combustion noise.

To detect heavy engine loads, prior-art two-point ignition systems usually comprises a vacuum switch disposed within the intake manifold, which is opened (or closed) when the absolute pressure within the intake manifold exceeds a predetermined pressure (approximately −80 mm Hg in gage pressure), that is, when engine load becomes heavy. In response to this switch signal indicative of heavy load, the ignition system is switched from two-point to one-point ignition.

In the prior-art two-point ignition system, however, while the engine is being started or warmed-up, since the pressure in the intake manifold rises as high as atmospheric pressure and thus the vacuum switch is opened as if engine load were heavy, the system is switched to one point ignition, in spite of the fact that two-point ignition is preferable in order to improve engine starting or idling performance.

To overcome this problem, the prior-art two-point ignition system usually comprises a clutch switch linked with the clutch pedal or the gear shift lever of the transmission mechanism which close when the engine is being started or warmed-up, or, in the case of an automatic transmission vehicle, a neutral switch is closed when the gear shift lever is set to the neutral or park positions in order to switch the systems to two-point ignition.

In summary, in the prior-art two-point ignition system, since heavy load is detected with a vacuum switch, in dependence upon change in absolute pressure within the engine intake manifold, in order to switch the control system from two-point to one-point ignition, a clutch switch or a neutral switch (or inhibit switch) is additionally required for preventing the system from being switched from two-point to one-point ignition while the engine is being warmed-up, thus resulting in a more complicated system configuration and a higher manufacturing cost.

Furthermore, there has been proposed another prior-art two-point ignition control system, by which two-point ignition is switched to one-point ignition when engine load is determined to be heavy in dependence upon the pulse width of a fuel-injection valve actuating signal. In this system, the pulse width is calculated on the basis of the amount of air supplied into the engine (detected by an air-flow meter). In such a prior-art two-point ignition control system, however, although there is no vacuum switch as described in the first prior-art system, there exists another problem in that two-point ignition is switched to one-point ignition whenever the pulse width of the fuel-injection valve actuating signal increases, for instance, due to engine idling, in spite of the fact that two-point ignition is necessary to improve ignition performance when the engine is being warmed-up.

SUMMARY OF THE INVENTION

With these problems in mind, therefore, it is the primary object of the present invention to provide a twin ignition plug control system for an internal combustion engine, the system configuration of which is simple and the manufacturing cost of which is low.

To achieve the above-mentioned object, many elements or sections for the twin ignition plug control system according to the present invention are used in common with a conventional fuel injection valve control system provided for the same internal combustion engine, without use of various additional sensors or detectors such as a vacuum sensor disposed within an intake manifold for detecting engine load, a clutch switch or a neutral switch for detecting engine idling, etc.

To embody the present invention, of course, it is necessary to provide some additional elements such as comparators, AND gates, inverters etc., however, where a microcomputer is incorporated within the fuel injection valve control system, it is easy to execute the same or similar calculations and/or operations in accordance with appropriate program stored therein. Further, while an air flow meter, an engine coolant temperature sensor, a starter switch etc. may be used with the present invention; these components are usually already present in the fuel injection valve control system for correcting the basic calculated pulse width of a fuel injection valve actuating signal.

BRIEF DESCRIPTION OF THE DRAWINGS

The features and advantages of the twin ignition plug control system for an internal combustion engine according to the present invention over the prior art ignition system will be more clearly appreciated from the following description of the preferred embodiments of the invention taken in conjunction with the accompanying drawings in which like reference numerals designate the same or similar sections throughout the figures thereof and in which.

DETAILED DESCRIPTION OF THE PREFERRED EMBODIMENTS

Figure 1:
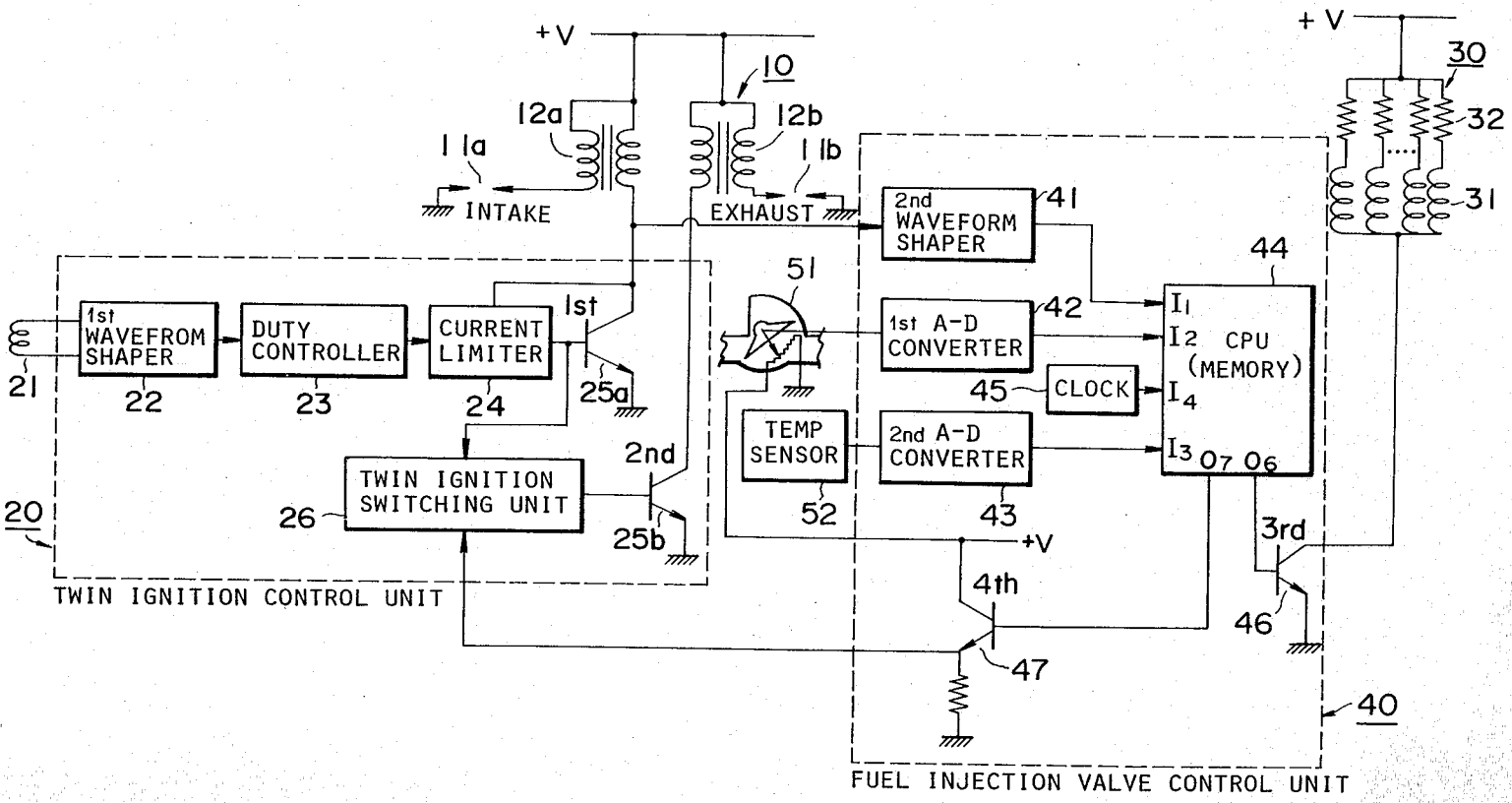
FIG. 1 is a schematic block diagram of a first embodiment of the twin ignition plug control system for an internal combustion engine according to the present invention.

FIG. 1 shows a schematic block diagram of a first embodiment of the twin ignition plug control system for a fuel-injection type internal combustion engine, by which two ignition plugs provided for each cylinder are switched from two-point ignition to one-point ignition or vice versa.

In the figure, the system roughly comprises an ignition coil unit 10, a twin ignition control unit 20, and electromagnetic fuel injection valve unit 30 and a fuel injection valve control unit 40.

The ignition coil unit 10 includes a pair of ignition plugs 11*a* and 11*b* disposed on the intake side and the exhaust side, respectively, of each combustion chamber of an internal combustion engine and a pair of ignition coils 12*a* and 12*b* for supplying ignition energy to the ignition plugs 11*a* and 11*b*, independently.

The ignition control unit 20 includes an electromagnetic pickup 21 disposed in a distributor (not shown) for outputting ignition timing signals at appropriate angular positions of the engine crankshaft, a first waveform shaper 22 for waveform-shaping the signal from the electromagnetic pickup 21, a duty controller 23 for obtaining a pulse signal having a constant dwell time, a current limiter 24 for limiting the current applied to the next stage, first and second power transistors 25*a* and 25*b* for supplying ignition energy to the ignition coils 12*a* and 12*b*, independently, being turned on in response to the current applied from the current limiter 24, and a twin-ignition switching unit 26 for connecting the timing signal from the current limiter 24 to the second power transistor 25*b* when a twin-ignition switching signal (described later) is not applied thereto and for disconnecting the timing signal from the current limiter 24 from the second power transistor 25*b* when the twin-ignition switching signal is applied thereto.

The electromagnetic fuel injection valve unit 30 includes a plurality of fuel injection valve actuating coils 31 and a plurality of current limiting resistors 32 connected in series with the valve coils 31.

The fuel injection valve control unit 40 for controlling the amount of fuel to be supplied to each engine cylinder includes a second waveform shaper 41 for waveform-shaping ignition timing signal from the primary winding of the ignition coil 12*a*, a first analog-to-digital converter 42 for converting analog signals from an air flow meter 51 into corresponding digital signals indicative of the amount of air supplied into the engine cylinder, a second analog-to-digital converter 43 for converting analog signals from an engine coolant temperature sensor 52 to corresponding digital signal indicative of temperature of engine coolant, a calculating section 44 or a microprocessor including a central processing unit, a random access memory and a read-only memory, a clock pulse generator 45 etc. and third and fourth power transistors 46 and 47 for amplifying the two signals outputted from the calculating section 44, independently.

In the section 44, label $I_1$ denotes a first input terminal to which an ignition timing signal from the intake-side ignition coil 12*a* is applied after being waveform-shaped by the second waveform shaper 41; label $I_2$ denotes a second input terminal to which an output signal from the air flow meter 51 is applied after being A-D converted by the first A-D converter 42, label $I_3$ denotes a third input terminal to which an output signal from the coolant temperature sensor 52 is applied after being A-D converted by the second A-D converter 43; label $I_4$ denotes a fourth input terminal to which a train of clock pulses from the clock pulse generator 45 is directly applied.

The calculating section 44 calculates an optimum pulse width of a fuel injection valve actuating signal and determines, based on engine load, whether the engine should be switched from two-point ignition to one-point ignition in accordance with the signals inputted to the calculating section 44.

The label $O_6$ denotes an output terminal from which a fuel-injection valve actuating pulse signal is applied to the fuel-injection valve actuating coil 31 after amplified through the third power transistor 46; the label $O_7$ denotes an output terminal from which a twin-ignition switching signal is applied to the twin-ignition switching unit 26 after being amplified through a fourth power transistor 47.

Figure 2:
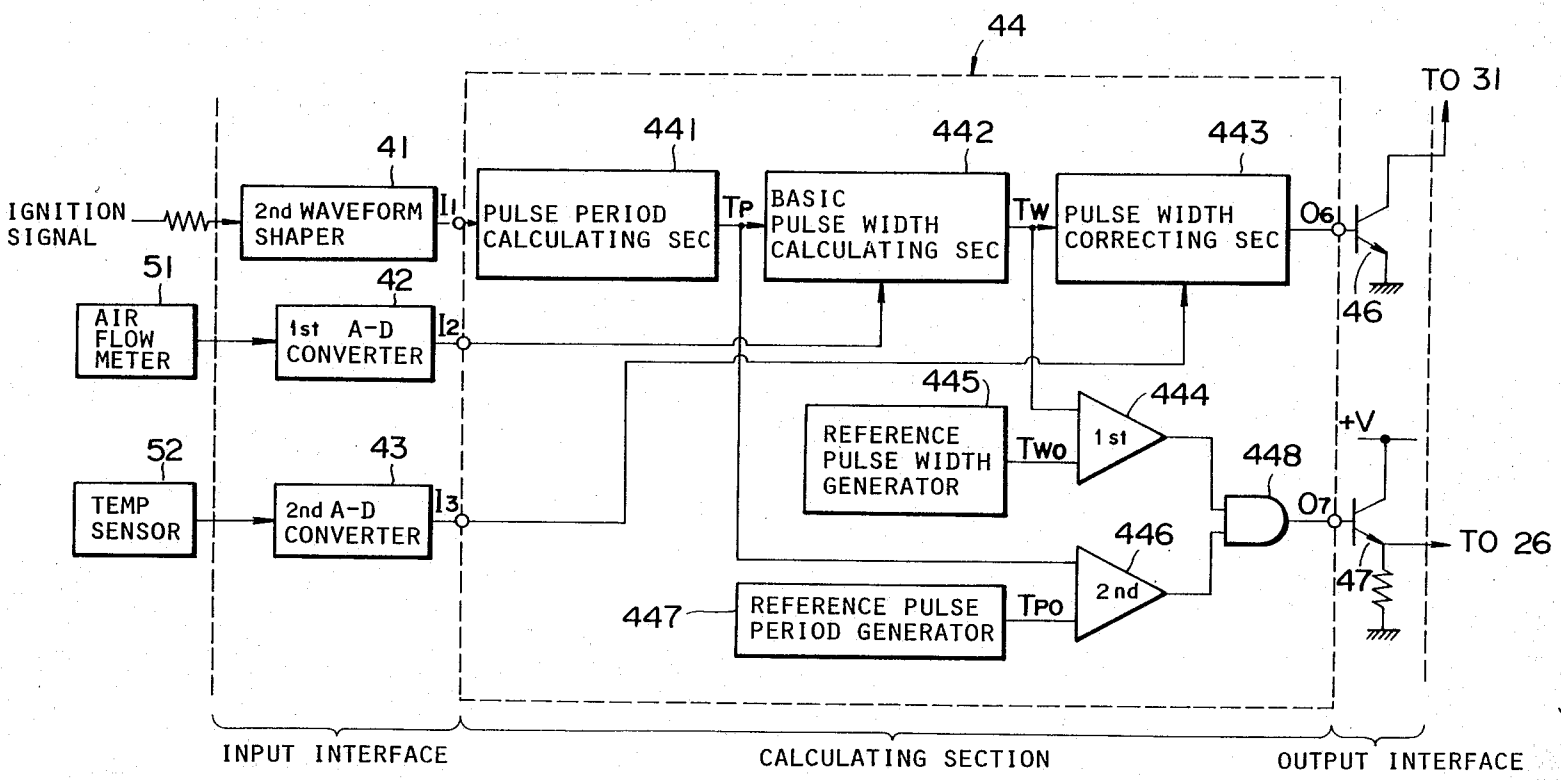
FIG. 2 is a partial detailed schematic block diagram of the embodiment shown in FIG. 1, illustrating an input interface, a calculating section, and an output interface, by which two-point ignition is switched to one-point ignition or vice versa in accordance with the basic pulse width of a fuel injection valve actuating signal and a pulse period of the ignition timing signal.

FIG. 2 is a more detailed partial schematic block diagram of the twin ignition plug control system illustrated in FIG. 1, in which the fuel injection valve control unit 40 is illustrated as being classified into three parts; an of input interface, a calculating section, and an output interface. The input interface, including the second waveform shaper 41, the first A-D converter 42 and the second A-D converter 43 and the output interface including the third power transistor 46 connected to the fuel injection valve unit 30 and the fourth power transistor 47 connected to the twin ignition switching unit 26, have already been described with reference to FIG. 1.

The calculating section 44 of FIG. 2 comprises various discrete elements or sections; however, it is of course possible to embody this calculating section of the fuel injection value control unit 40 with a microcomputer. In that case, all processes, calculations and/or operations are executed in accordance with appropriate program stored in a read-only memory of the microcomputer.

In FIG. 2, the reference numeral 441 denotes a pulse period calculating section for calculating the pulse period $T_p$ of the ignition timing signals from the intake-side ignition coil 12a on the basis of clock pulse signals (shown in FIG. 1); the reference numeral 442 denotes a basic pulse width calculating section for calculating a basic pulse width $T_w$ of the fuel-injection valve actuating signal on the basis of the calculated pulse period $T_p$ (or engine speed) and the amount of air supplied to the engine cylinders; the reference numeral 443 denotes a pulse width correcting section for correcting the basic pulse width $T_w$ of the fuel-injection valve actuating signal on the basis of the signals from various sensors such as the temperature sensor 52 in order to increase the amount of fuel supplied to the engine cylinders while the engine is being warmed up. The time during which the engine is being warmed-up means herein the time during which the engine is being started or cranked and thereafter being idled or operated until various temperatures, for instance, in the combustion chamber, engine lubricant, engine coolant, etc. rise to an appropriate temperature (e.g. 80°° C.) at which fuel is efficiently burnt. The elements 441, 442 and 443 are all well known components of a fuel injection rate control/calculation section of an electronically controlled fuel injection valve control system.

In addition to these known elements, the fuel injection valve control unit 40 according to the present invention further comprises a reference pulse width generator 445 for generating a reference injection pulse width $T_{wo}$ of the fuel injection valve actuating signal (in the case of a microcomputer, this reference value $T_{wo}$ is read from a memory unit, not shown), a first comparator 444 for comparing the calculated basic injection pulse width $T_w$ with the reference injection pulse width $T_{wo}$ and outputting a signal indicative of heavy engine load when the calculated value $T_w$ exceeds the reference value $T_{wo}$, a reference injection period generator 447 for generating a reference injection pulse period $T_{po}$ of the fuel injection valve actuating signal (in the case of a microcomputer, the reference value $T_{po}$ is read from a memory unit, not shown), a second comparator 446 for comparing the calculated injection pulse period $T_p$ with the reference injection pulse period $T_{po}$ and outputting a signal indicative of high engine speed when the calculated value $T_p$ drops below the reference value $T_{po}$ and an AND gate 448 for outputting a twin-ignition switching signal to obtain one-point ignition when both the first and second comparators 444 and 446 output a H-voltage level signal simultaneously to the two input terminals thereof.

The operation of the system according to the present invention will now be described.

The ignition timing signals outputted from the first ignition coil 12a is applied to the pulse period calculating section 441 through the second waveform shaper 41. In the case where a microcomputer is utilized, these ignition signals serve as an interrupt signal for implementing the necessary operations for the fuel injection value control unit 40 in accordance with software stored therein.

The pulse period calculating section 441 calculates the current pulse period $T_p$ of the ignition timing signal according to the difference between the preceding leading edge of the timing signal and the current leading edge of the timing signal on the basis of the clock pulse signal inputted thereto. Here, since the pulse period $T_p$ is inversely proportional to engine revolution speed, it is possible to detect engine speed by calculating the pulse period $T_p$.

The digital air flow signal is applied to the basic pulse width calculating section 442 through the first A-D converter 42. The basic pulse width calculating section 442 calculates a basic pulse width $T_w$ of fuel-injection value actuating signal on the basis of the current pulse period $T_p$ from the pulse period calculating section 441 and the digital air flow signal from the first A-D converter 42.

Here, since the output signal level U of the air-flow meter 52 is so designed as to be inversely proportional to the amount Q of air supplied into the engine cylinders per second, the basic pulse width $T_w$ can be expressed as follows:

$$T_w = k_1 \times \frac{T_p}{U} = k_1 \frac{T_p}{k_2/Q} = K.T_p \times Q$$

where $k_1$, $k_2$ and K are all constants. Therefore, the greater the amount Q of air, the wider the pulse width $T_w$.

Next, the calculated basic pulse width $T_w$ is compared with the reference value $T_{wo}$ by the first comparator 444. When the basic value $T_w$ exceeds the reference value $T_{wo}$ the first comparator 444 outputs a H-voltage level signal indicative of heavy engine load.

In the prior-art system, a vacuum switch disposed within the intake manifold is used for detecting a heavy engine load condition, depending upon the fact that the pressure within the intake manifold rises when engine load becomes heavy.

In contrast, in the system according to the present invention, without use of any vacuum switch, heavy engine load can be detected when the basic ignition pulse width $T_w$ exceeds a reference value $T_{wo}$. This is because that as engine load becomes heavy, the amount Q of air increases and therefore the ignition pulse width $T_w$ increases.

However, when the engine is being warmed up, since engine speed is low and therefore the pulse period $T_p$ is long, the pulse width $T_w$ becomes great even if Q is at a minimum, exceeding the reference value $T_{wo}$. In other words, the pulse width $T_w$ increases as if engine load were heavy.

In order to overcome this problem, the system according to the present invention further comprises a second compartor 446 for comparing the pulse period $T_p$ with the reference value $T_{po}$ and outputting a H-voltage level signal indicative of high engine speed only when $T_p$ drops below $T_{po}$ in order to prevent the system from being switched to one-point ignition while the engine is being warmed-up.

In more detail, when the engine is being warmed up, the engine speed is low and thereby the pulse period $T_p$ is long and thus the pulse width $T_w$ is wide, so that the first comparator 444 outputs a H-voltage level signal falsely indicating a heavy engine load. However, since the second compartor 446 does not output an H-voltage level signal, indicating that the engine speed is low while the engine is being warmed up, the AND gate 448 will not output a H-voltage level signal to turn on the transistor 47, that is, to switch the ignition control unit to one-point injection, while the engine is being warmed up.

Only when the basic pulse width $T_w$ exceeds the reference value $T_{wo}$ (engine load is heavy) and when the pulse period $T_p$ drops below the reference value $T_{po}$ (engine speed is high), the power transistor 47 is turned on. In response to the signal from the power transistor 47, the twin-ignition switching unit 26 is actuated so as to turn off the transistor 35*b* so that two-point ignition is switched to one-point ignition in order to reduce the combustion speed and thus combustion noise.

Figure 3:
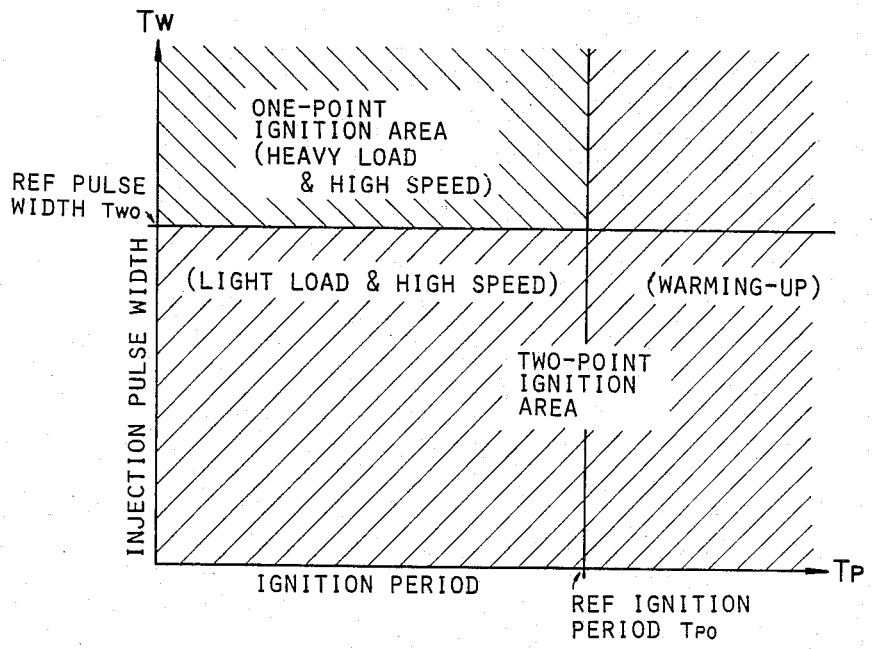
FIG. 3 is a graphical representation showing the areas of one-point ignition and two-point ignition with the injection valve pulse width as ordinate and with ignition period as abscissa.

On the other hand, when the basic pulse width $T_w$ drops below the reference value $T_{wo}$ (engine load is light) or when the pulse period $T_p$ exceeds the reference value $T_{po}$ (engine speed is low), the power transistor 47 is turned off, so that two-point ignition is kept performed in order to increase combustion speed and thus reliably ignite the mixture including relatively great amount of recirculated exhaust gas. FIG. 3 depicts one- and two-point ignition areas in conjunction with ignition pulse width (engine load) and ignition period (engine speed).

When a microcomputer is used for system according to the present invention, since many elements or sections are used in common with the conventional fuel injection valve control system and since the additional elements or sections such as comparators 444 and 446 and the AND gate 448 can easily be incorporated within the microcomputer, it is possible to simplify the system configuration without use of any other sensors for detecting engine warm-up.

Furthermore, it is also possible to detect engine warm-up conditions by counting the number of pulse signals outputted from an engine speed sensor (not shown) such as an electromagnetic pickup, instead of counting the pulse period $T_p$ of the fuel-injection valve actuating signal. In this case, the value indicative of engine speed is compared with a reference engine speed by the second comparator 446 for detecting whether or not the engine is being warmed up.

Figure 4:
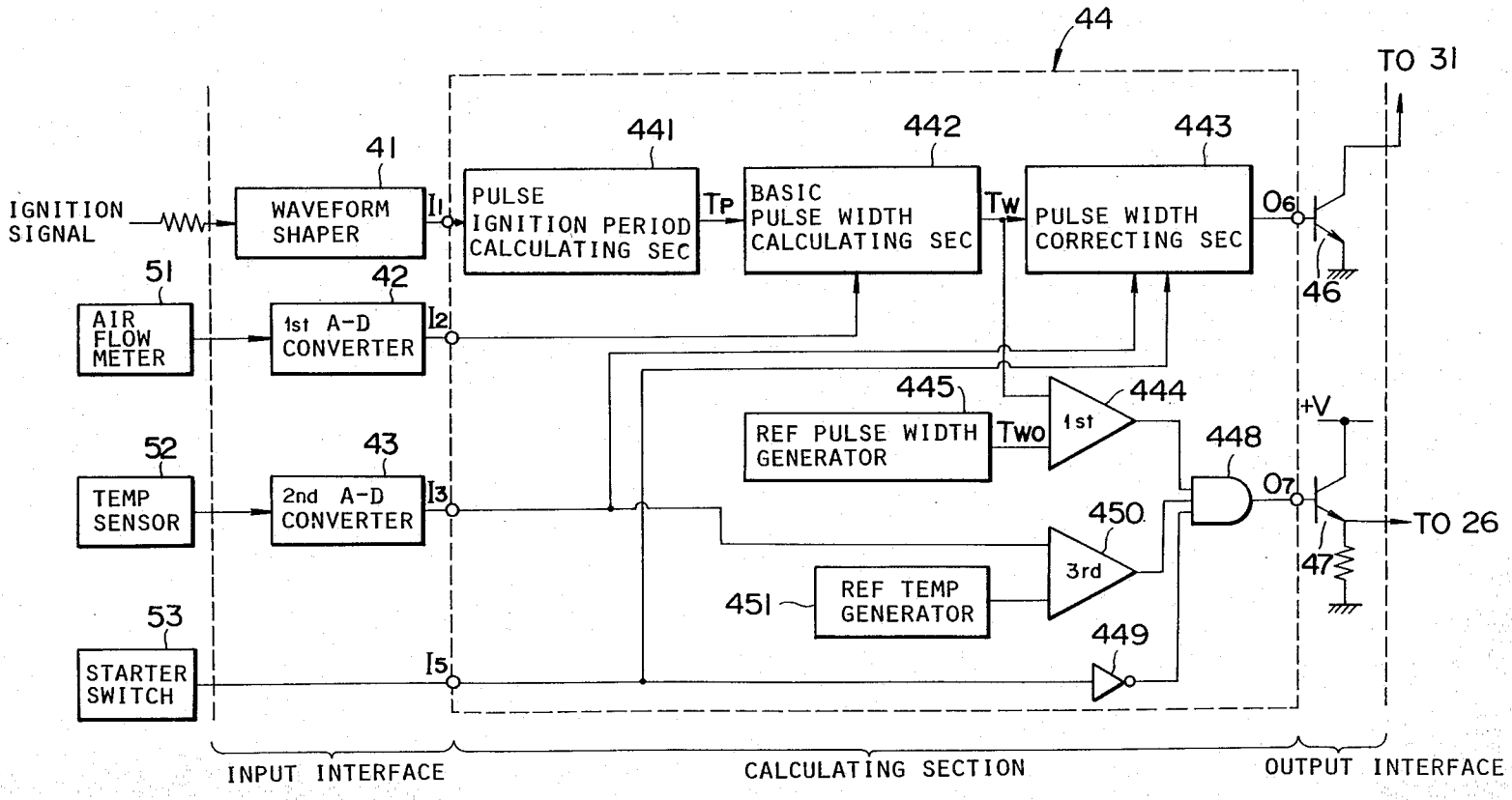
FIG. 4 is a partial detail schematic block diagram of a second embodiment of the twin ignition plug control system according to the present invention, illustrating an input interface, a calculating section, and an output interface, by which two-point ignition is switched to one-point ignition or vice versa in accordance with the basic pulse width of the fuel injection valve actuating signal, engine coolant temperature, and engine starting condition.

FIG. 4 shows a second embodiment of the twin ignition plug control system according to the present invention. In this embodiment, the system further comprises an engine coolant temperature sensor 52, a second A-D converter 43, a reference temperature generator 451, a third comparator 450, a starter switch 53 and an inverter 449, in order to detect whether or not the engine is being warmed-up, in place of the second comparator 446 (shown in FIG. 2) for detecting whether or not engine speed is high.

In more detail, when the engine is being warmed-up, engine coolant temperature is lower than a reference temperature (e.g. 80° C.), so that the third comparator 450 outputs a L-voltage level signal indicative of low coolant temperature.

Further, when the engine is being started or cranked, the starter switch 53 outputs a H-voltage level signal, so that the inverter 449 outputs a L-voltage level signal indicative of engine starting condition.

Therefore, even when the basic pulse width $T_w$ exceeds the reference value $T_{wo}$ and the first comparator 444 outputs a H-voltage level signal indicative of heavy engine load, as far as the engine is being warmed-up or started, the AND gate 440 does not output a H-voltage level signal to turn on the power transistor 47, so that two-point ignition is maintained in order to increase combustion speed and thus reliably ignite the mixture which may include a relatively large amount of recirculated exhaust gas.

On the other hand, when the engine is not being warmed-up and not being started, since the third comparator 450 and the inverter 449 both output two H-voltage level signals, the AND gate 448 outputs a H-voltage level signal to the power transistor 47 only when the basic pulse width $T_w$ exceeds the reference value $T_{wo}$ (engine load is heavy). Therefore, two-point ignition is switched to one-point ignition in order to reduce the combustion speed and thus combustion noise.

The temperature sensor 52 and the starter switch 53 are usually used with conventional fuel injection valve control units in order to correct the pulse width of the fuel injection valve actuating signal when the engine is being warmed-up or started; therefore, in most cases it is unnecessary to provide an additional temperature sensor and an additional starter switch for the system according to the present invention.

As described above, in the twin ignition plug control system for an internal combustion engine according to the present invention, since switching of two-point ignition to one-point ignition or vice versa is determined on the basis of the pulse width (engine load) of the basic fuel injection valve actuating signal not directly related to engine warming-up condition, and the pulse period (engine speed) of the fuel injection valve actuating signal or the signals from the temperature sensor (warm-up) and the starter switch (engine start), it is possible to determine engine load and warm-up conditions, independently, without use of any other sensors for detecting that the engine is being warmed up, thus reducing the manufacturing cost. Furthermore, since two-point ignition is switched to one point ignition only when engine load is heavy and engine speed is high, it is possible to effectively reduce combustion noise, while maintaining two-point ignition when the engine is being warmed up, in order to increase combustion speed and thus reliably ignite even those air-fuel mixtures which include relatively large amounts of recirculated exhaust gas.

It will be understood by those skilled in the art that the foregoing description is in terms of a preferred embodiment of the present invention wherein various changes and modifications may be made without departing from the spirit and scope of the invention, as set forth in the appended claims.

What is claimed is:

1. A twin ignition plug control system for controlling first and second ignition coils respectively supplying ignition energy to first and second ignition plugs which are respectively disposed on an intake port side and an exhaust port side of a cylinder of an engine having a crankshaft, the control system comprising:

(a) means for timing ignition energy to the first and second ignition coils in accordance with angular positions of said crankshaft and for outputting ignition signals, said timing means including a twin-ignition switch for switching between two-point ignition and one-point ignition;

(b) means for detecting an amount of air supplied to the engine and for outputting an air flow quantity signals;

(c) means for calculating a pulse period $T_p$ of the ignition signals and for outputting an ignition timing signal pulse period signal;

(d) means for calculating a basic pulse width $T_w$ of a fuel injection valve actuating signal based on the pulse period $T_p$ and the amount of air supplied to the engine and for outputting a basic pulse width signal; and (e) means for determining when engine load is heavy, said determining means being connected to said basic pulse width calculating means and operable to output a signal indicative of heavy engine load when the basic pulse width $T_w$ exceeds a reference value $T_{wo}$ and for thereupon switching said twin-ignition switch from two-point ignition to one-point ignition.

2. A twin ignition plug control system as set forth in claim 1, further comprising:

(a) means for detecting when the engine has warmed-up and for outputting a warmed-up engine indicative signal; and (b) means, connected to said engine load determining means and said warmed-up engine detecting means for generating a switching signal to switch said twin-ignition switch from two-point ignition to one-point ignition;

whereby two-point ignition is switched to one-point ignition when engine load is heavy after the engine is warmed-up.

3. A twin ignition plug control system as set forth in claim 1, wherein said engine load determining means comprises a first comparator connected to said basic pulse width calculating means for comparing the basic pulse width $T_w$ with a reference pulse width $T_{wo}$ and for outputting a signal indicative of a heavy engine load when the calculated basic pulse width exceeds the reference pulse width.

4. A twin ignition plug control system as set forth in claim 2, wherein said warmed-up engine detecting means comprises a second comparator connected to said pulse period calculating means for comparing the pulse period $T_p$ with a reference pulse period $T_{po}$ and for outputting a signal indicative of a warmed-up engine condition when the pulse period drops below the reference pulse period.

5. A twin ignition plug control system as set forth in claim 2, wherein said warmed-up engine detecting means comprises:

(a) an engine temperature sensor for outputting a signal indicative of engine temperature; and (b) a third comparator connected to said temperature sensor for comparing the detected temperature with a reference value and outputting a signal indicative of a warmed-up engine condition when the detected temperature exceeds the reference value.

6. A twin ignition plug control system as set forth in claim 2, wherein said warmed-up engine detecting means comprises:

(a) a starter switch for outputting a signal indicative of an engine starting condition; and (b) an inverter connected to said starter switch for outputting a signal indicative of a no engine start condition.

7. A twin ignition plug control system as set forth in claim 1, wherein said means for detecting the amount of air, said means for calculating the pulse period $T_p$, and said means for calculating the basic pulse width $T_w$ of a fuel injection valve actuating signal are associated with a fuel injection valve control of said engine.

8. A twin ignition plug control system as set forth in claim 5, wherein said temperature sensor is associated with a fuel injection valve control system of said engine.

9. A twin ignition plug control system as set forth in claim 6, wherein said starter switch is associated with a fuel injection valve control system of said engine.

10. A twin ignition plug control system for controlling first and second ignition coils which respectively supply ignition energy to first and second ignition plugs respectively disposed on an intake port side and an exhaust port side of a cylinder of an engine having a crankshaft, said control system comprising:

(a) an electromagnetic pickup for generating ignition timing signals at predetermined angular positions of said crankshaft;

(b) a first ignition coil switching element connected to said electromagnetic pickup and operable to control ignition energy to said first ignition coil in response to the ignition timing signals;

(c) a twin-ignition switch connected to said electromagnetic pickup for normally passing said ignition timing signals and responsive to a switching signal for blocking said ignition timing signals;

(d) a second ignition coil switching element connected to said electromagnetic pickup via said twin-ignition switch for supplying ignition energy to the second ignition coil in response to the ignition timing signals whenever said ignition timing signals are passed via said twin-ignition switch thereto;

(e) a pulse period calculating means connected to the first ignition coil for calculating a pulse period $T_p$ of the ignition timing signals and for outputting signals corresponding thereto;

(f) an air flow meter for detecting an amount of air supplied to the engine and for outputting an air-flow quantity signal;

(g) a basic pulse width calculating means, connected to said pulse period calculating means and said air flow meter, for calculating a basic pulse width $T_w$ of a fuel injection valve actuating signal based on the pulse period $T_p$ and the air flow quantity signal;

(h) a first comparator connected to said basic pulse width calculatin means for comparing the calculated basic pulse width $T_w$ with a reference pulse width $T_{wo}$ and for outputting a signal indicative of heavy engine load when the calculated basic pulse width exceeds the reference pulse width;

(i) a second comparator connected to said pulse period calculating means for comparing the pulse period $T_p$ with a reference pulse period $T_{po}$ and for outputting a signal indicative of high engine speed when the calculated pulse period $T_p$ drops below the reference pulse period $T_{po}$; and (j) a logic gate connected to said first and second comparators for generating said switching signal for blocking the ignition timing signals to said second ignition coil switching element whereby two-point ignition is switched to one-point ignition when engine load is heavy and engine speed is high.

11. A twin ignition plug control system for controlling first and second ignition coils which respectively supply ignition energy to first and second ignition plugs which are respectively disposed on an intake port side and an exhaust port side of a cylinder of an engine having a distributor and a crankshaft, said control system comprising:

(a) an electromagnetic pickup disposed in said distributor for generating ignition timing signals at predetermined angular positions of said crankshaft;

(b) a first ignition coil switching element connected to said electromagnetic pickup and operable to control ignition energy to said first ignition coil in response to the ignition timing signals;

(c) a twin-ignition switch connected to said electromagnetic pickup for normally passing said ignition timing signals and responsive to a switching signal for blocking said ignition timing signals;

(d) a second ignition coil switching element connected to said electromagnetic pickup via said twin-ignition switch for supplying ignition energy to the second ignition coil in response to the ignition timing signals whenever said ignition timing signals are passed via said twin-ignition switch thereto;

(e) a pulse period calculating means connected to the first ignition coil for calculating the pulse period $T_p$ of the ignition timing signals and for outputting signals corresponding thereto;

(f) an air flow meter for detecting an amount of air supplied to the engine and for outputting an air flow quantity signal;

(g) a basic pulse width calculating means, connected to said pulse period calculating means and said air flow meter, for calculating a basic pulse width $T_w$ of a fuel injection valve actuating signal based on the pulse period $T_p$ and the air flow quantity signal;

(h) a first comparator connected to said basic pulse width calculating means for comparing the calculated basic pulse width $T_w$ with a reference pulse width $T_{wo}$ and for outputting a signal indicative of heavy engine load when the calculated basic pulse $T_w$ width exceeds the reference pulse width $T_{wo}$;

(i) a temperature sensor for outputting an engine temperature indicative signal;

(j) a second comparator connected to said temperature sensor for comparing the engine temperature indicative signal with a reference value and for outputting a signal indicative of high engine temperature when the detected temperature exceeds the reference value;

(k) a starter switch for starting said engine;

(l) a monitor connected to said starter switch, for outputting a signal indicative of a no engine start condition; and (m) a logic date connected to said first comparator, said second comparator and said monitor for generating said switching signal for blocking the ignition timing signals to said second ignition coil switching element whereby two-point ignition is switched to one-point ignition when engine load is heavy, engine temperature is high, and the engine is not being started.

12. A twin-ignition plug control system for controlling first and second ignition coils which respectively supply ignition energy to first and second ignition plugs respectively disposed on an intake port side and an exhaust port side of a cylinder of an engine having a crankshaft, said control system comprising:

(a) an electromagnetic pickup for generating ignition timing signals at predetermined angular positions of said engine crankshaft;

(b) a first ignition coil switching element connected to said electromagnetic pickup and operable to control ignition energy to the first ignition coil in response to the ignition timing signals;

(c) a twin-ignition switch connected to said electromagnetic pickup for normally passing said ignition timing signals and responsive to a switching signal for blocking said ignition timing signals;

(d) a second ignition coil switching element connected to said electromagnetic pickup via said twin-ignition switch for supplying igition energy to the second ignition coil in response to the ignition timing signals whenever said ignition timing signals are passed via said twin-ignition switch thereto;

(e) an air flow meter for detecting the amount of air supplied to the engine and for outputting an air flow quantity signal; and (f) a microcomputer having a central processing unit, a read-only memory and a random-access memory, connected to said first ignition coil and said air flow meter, for calculating a pulse period $T_p$ of the ignition timing signals in accordance with clock pulse signals, and for calculating a basic pulse width $T_w$ of a fuel injection valve actuating signal on the basis of the calculated pulse period and the air flow quantity signal, and for comparing the calculated basic pulse width $T_w$ of a fuel injection valve actuating signal on the basis of the calculated pulse period and the air flow quantity signal, and for comparing the calculated basic pulse width $T_w$ with a reference pulse period $T_{po}$, and for generating said switching signal whenever the calculated basic pulse width exceeds the reference pulse width and the calculated pulse period drops below the reference pulse period to block the ignition timing signals to said second ignition coil switching element whereby two-point ignition is switched to one-point ignition when engine load is heavy and engine speed is high.

13. A twin ignition plug control system for controlling first and second ignition coils which respectively supply ignition energy to first and second ignition plugs respectively disposed on an intake port side and an exhaust port side of a cylinder of an engine having a crankshaft, said control system comprising:

(a) an electromagnetic pickup for generating ignition timing signals at predetermined angular positions of said crankshaft;

(b) a first ignition coil switching element connected to said electromagnetic pickup and operable to control ignition energy to the first ignition coil in response to the ignition timing signals;

(c) a twin-ignition switch connected to said electromagnetic pickup for normally passing said ignition timing signals and responsive to a switching signal for blocking said ignition timing signals;

(d) a second ignition coil switching element connected to said electromagnetic pickup via said twin-ignition switch for supplying ignition energy to the second ignition coil in response to the ignition timing signals whenever said ignition timing signals are passed via said twin-ignition switch thereto;

(e) an air flow meter for detecting the amount of air supplied to the engine and for outputting an air flow quantity signal;

(f) a temperature sensor for outputting a signal indicative of engine temperature;

(g) a starter switch for outputting a signal indicative of an engine starting condition; and (h) a microcomputer having a central processing unit, a read-only memory and a random-access memory, and connected to said first ignition coil, said air flow meter, said temperature sensor, and said starter switch, for calculating a pulse period $T_p$ of the ignition timing signals in accordance with clock pulse signals, for calculating a basic pulse width $T_w$ of a fuel injection valve actuating signal on the basis of the calculated pulse period and the air flow quantity signal, and for comparing the calculated basic pulse width $T_w$ with a reference pulse width $T_{wo}$ and for comparing the detected engine indicative temperature with a reference temperature, and for determining when said engine is not in a starting condition and for generating said switching signal whenever the calculated basic pulse width exceeds the reference pulse width, and the detected engine indicative temperature exceeds the reference temperature and the engine is not in a start condition to block the timing ignition signals to said second ignition coil switching element whereby two-point ignition is switched to one-point ignition when engine load is heavy, engine temperature is high, and the engine is not being started.

* * * * *